United States Patent [19]

Balaz

[11] 4,456,251

[45] Jun. 26, 1984

[54] TENNIS BALL REBOUND PRACTICE NET

[75] Inventor: Anton Balaz, Altmünster, Fed. Rep. of Germany

[73] Assignee: Plaspack Kunststoff GmbH & Co. KG, Schwanenstadt, Australia

[21] Appl. No.: 179,160

[22] Filed: Aug. 18, 1980

[30] Foreign Application Priority Data

Aug. 16, 1979 [DE] Fed. Rep. of Germany ... 7923451[U]

[51] Int. Cl.[3] ..... A63B 69/40

[52] U.S. Cl. ..... 273/29 A; 273/395

[58] Field of Search ..... 273/29 A, 127 C, 127 B, 273/127 R, 26 A, 181 R, 181 F, 181 K, 181 I, 181 U, 73 D, 73 E, 395

[56] References Cited

U.S. PATENT DOCUMENTS

| | | | |
|---|---|---|---|
| 3,633,909 | 1/1972 | Doynow | 273/26 A |
| 3,692,307 | 9/1972 | Henry | 273/29 A |
| 4,206,916 | 6/1980 | Epply | 273/29 A |

FOREIGN PATENT DOCUMENTS

| | | | |
|---|---|---|---|
| 2449480 | 4/1976 | Fed. Rep. of Germany | 273/73 D |
| 227412 | 7/1925 | United Kingdom | 273/73 E |

*Primary Examiner*—Richard C. Pinkham
*Assistant Examiner*—T. Brown
*Attorney, Agent, or Firm*—Anthony A. O'Brien

[57] ABSTRACT

Tennis training equipment is constructed of a net supported by a frame. The net acts as a catch and return surface for a tennis ball hit against it and is made from vertically extending elastic elements and horizontally extending substantially inelastic elements. The tensions of the vertically extending elements may be varied by adjusting the frame in the vertical direction. The inclination of the net may be varied by tilting the frame. These features permit the flight characteristics of return balls to be controlled according to the abilities of a user of the equipment.

2 Claims, 1 Drawing Figure

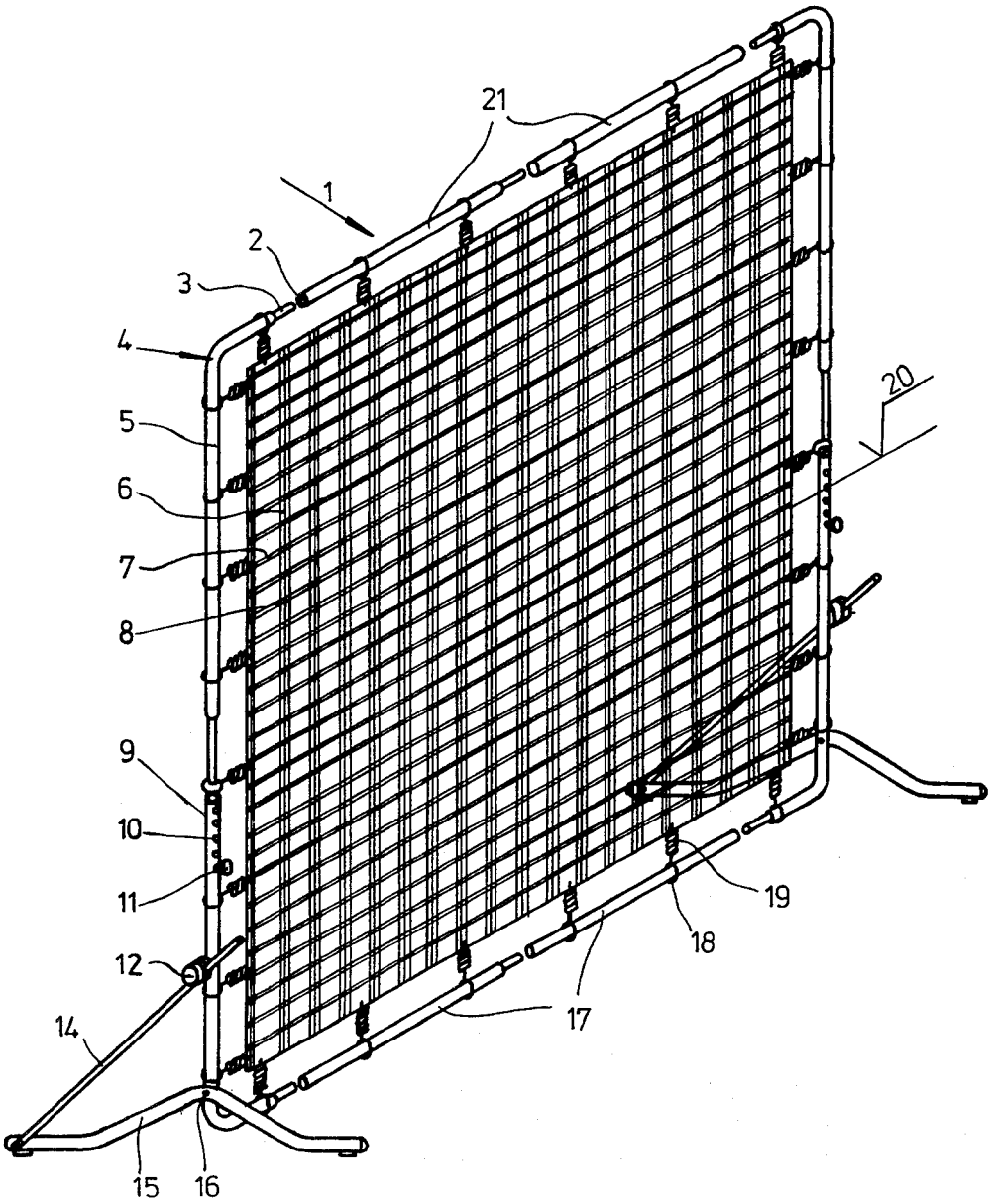
1
2
3
4
5
6
7
8
9
10
11
12
14
15
16
17
18
19
20
21

TENNIS BALL REBOUND PRACTICE NET

The invention is concerned with a piece of tennis training equipment.

As is known, such a piece of tennis training equipment consists of a square frame and a net stretched across it. The net also is square and serves as a surface for receiving and returning tennis balls that are hit into the net.

An object of the invention is to provide a piece of tennis training equipment can be used by anyone from a beginner to a professional—that is, wherein the ball can be hit with full force and by which the ball is returned more quickly or less quickly, as desired. The path followed by the ball when it is returned (that is, short, quickly and deep or slowly and high, or unchanged) can be subjected to infinitely variable adjustment, as desired, to simulate various playing situations. Furthermore, the device must be stable and weather-resistant, it must not rot, it must not absorb any water and must be extremely resistant to breaking. It should also be possible to make use of it in small spaces such as a front yard or basement and in addition should be easy to transport and pack.

Accordingly, the tennis training equipment of the invention has a net whose horizontal strings actually are not elastic and whose vertical strings are elastic, while its frame can be pushed apart and pushed together in the vertical direction. As a result, the tension of the net can be adjusted, so that a more or less hard or soft return of the ball is obtained, as desired. To accomplish this, the frame is fastened to a base by means of joints and arresting devices for the purpose of tilting and arresting, as desired. By tilting the net over the frame and arresting it in the desired tilted position, simulating various playing situations is made possible. Thus, for example, by tilting the net forward, the ball is returned short, quickly and deep, while tilting the net backward causes the ball to roll rather high on the net and consequently to return slowly and high, so that even a beginner has enough time to recover.

According to a further development of the invention, the base resembles an inverted capital V with its arms spread apart more than 90°, with an axis passing through the frame being attached at the point where the arms join and constituting the rotating joint of the device.

In another, further development of the idea of the invention, the arresting device consists of a post jointed in the area of the end of the arm of the base which passes through a releasable clamping part that is attached to the frame above the axis. If the angle of adjustment is to be changed, the clamping part is first loosened, thus releasing the post that is jointed to the base, and then the frame is rotated through the desired angle around the joint that connects it with the base, and then the post of the arresting device is clamped tight again and the desired stiffness is restored.

In order to reproduce the playing situation in as real a manner as possible, the net of the invention has a horizontal color division in its central area; the two colors, light green and dark green can be used to make this distinction, using one above the height of the tennis net and the other below it, so that the player can see how high he must hit the ball.

It is advantageous for the frame of the tennis training equipment to be made of several tubes that can easily be joined together by slipping one inside the other. The flexible couplings at the base can also easily be removed from the frame so that the entire device can be broken down into relatively small, individual parts and can be packed in a suitable bag, and that makes it considerably easier to store and also to transport it from and to the place where one practices.

The net, which is fixed in the horizontal plane and elastic in the vertical plane, consists of Hostalen strip material that is extremely resistant to breaking, for example, it is protected against ultraviolet rays and does not absorb any water, does not rot and thus is stable and weather-resistant.

As a result of the many possible variations provided by the invention and the adjustable net tension and angle at which the ball strikes the net, the device can be used in extremely small areas, such as backyard, frontyard or in the basement, and can be a real piece of training equipment for anyone from beginner to professional, since the ball can be hit with full force because of the cushioning of the net against which it is hit.

BRIEF DESCRIPTION OF THE DRAWING

The features of the tennis training equipment of the invention will be explained in the following description in connection with the embodiment reproduced in the drawing, the single FIGURE of which is a perspective view of the equipment.

DETAILED DESCRIPTION

The device 1 represented in the drawing consists of a square frame 4 that is made up of a number of individual parts, and specifically of the upper cross tubes 21, the lower cross tubes 17, an upper side tube 5 on each side and a lower side tube 9 on each side. These tube parts are connected with each other by conventional socket connections such as a pin 3 fastened in one tube part and an opening 2 provided in the other tube part. At the upper end of each lower side tube 9, a number of holes 10 are drilled through vertically into which adjustment bolts 11 are inserted depending on the frame height or the net tension that is desired. Such a length of the frame parts 21, 17, 9, 5 is selected that when the frame is taken apart, the parts are managable and easy to pack, while their number and dimensions depend on the size of the frame and the net or on the desired size of the package containing the disassembled device. The base 15 is fastened to the lower end of the lower side tube 9 by means of an axis 16 passing through the frame 4, and it resembles an inverted capital V with its arms spread more than 90° apart, with the axis 16 being located at the point where the two arms join. The legs of the base 15 are spread relatively far apart and consequently a greater stability of the device is obtained. In the area of the end of one of the legs of the base 15, at each end of the device, a post 14 is connected that passes through a releasable, conventional clamping part 12 that is attached to the frame 4 above the axis 16. It is easy to release and to block this clamping part 12 by hand then the frame 4 can be rotated very quickly and easily as desired. Moveable rings 18, arranged essentially symmetrically, are provided on the frame 4 to which springs 19 are fastened which are provided with means of fastening, such as hooks, by means of which they catch in a net 8 and hold it firmly to the frame 4 with a specific tension in the horizontal and vertical planes. This net 8 consists of horizontal strings 7 that are essentially inelastic, vertical strings 6, which are elastic whereby the vertical tension can be adjusted, as desired, by the tightening and loosening device, which consists of the holes 10 drilled in the lower side tube and the adjusting bolt 11.

Because of the elasticity of the vertical strings of the net 8 and the possibility of adjusting the tension, the springs 19 at the upper and lower sides of the net can be omitted and the net can be fastened directly to the rings 18, as a result of which approximately half of these springs 19 can be saved.

It is possible to form the linkage of the frame 4, the base 15 and the post 14 of solid material or of hollow profile material, preferably of steel tubes, which make a desirable lightness as well as the required firmness and stability possible.

The colors of the strings 7 are set off from each other opposite the number 20; for example, the horizontal strings 7 below the number 20 are light in color, while the strings lying above the line 20 have a considerably darker color. It is very simple and easy to put the tennis training device together and to take it apart. When taking it apart for example, the clamping part 12 must be loosened and the post 14 removed from it, and then the attachment of the base 15 to the frame 4 above the axis 16 must be slightly loosened by screws in a familiar manner. Then, the adjusting bolt 11 is removed from one of the drilled holes 10, and as a result the tension of the net in the vertical plane is removed, so that the upper and lower cross tubes 21 or 17 can be pushed apart against the horizontal spring tension more easily. Then, the individual parts of the frame are removed from the rings 18 and the springs 19 are removed together with the rings 18 from the net 8. Then, all the parts can be put in an appropriate bag in a nice bundle, and that makes it easy to transport and store the device, for example, in the trunk of a car.

I claim:

1. A tennis training device comprising:

a four-sided frame (4) adapted to be supported on the ground and having a pair of spaced vertical sides (5, 9) joined to a pair of spaced horizontal sides (17, 21);

a net (8) having an outline similar to that of said frame (4) and being disposed inside said frame (4);

a plurality of resilient means (19) connecting said net (8) to said frame (4);

said net (8) having a first plurality of strings (6) extending in a vertical direction and being elastic, and having a second plurality of strings (7) extending in a horizontal direction and being inelastic;

said net (8) adapted to act as a catch and return surface for a tennis ball impinging against said net (8);

adjustment means (10, 11) on each vertical side (5, 9) of said frame (4) for adjusting the distance between the pair of spaced horizontal sides (17, 21) and thereby adjusting the tension in said first plurality of strings whereby the speed of return of the tennis ball is adjusted;

a ground support for each vertical side (5, 9) including a stand (15) having a ground engaging part and a shaft (16) pivotally carrying its adjacent vertical side (5, 9), an inclined bar (14) pivotally connected at one end to said stand (15), and releasable clamp means (12) mounted on said adjacent vertical side (5, 9) in spaced vertical relation above said shaft (16), said bar (14) having an opposite end passing through said clamp means (12) whereby movement of said bar (14) relative to said clamp means (12) effects adjustment of the angle of inclination of said frame (4) relative to the ground to select the direction of return of the tennis ball.

2. A tennis training device as claimed in claim 1 wherein said net (8) has a horizontally extending color division to define a serving height.

* * * * *